United States Patent [19]

Chovin et al.

[11] Patent Number: 4,928,270

[45] Date of Patent: May 22, 1990

[54] DIGITAL TIMER WITH CONSTANT RESOLUTION

[75] Inventors: André Chovin, Crest; Jacques Taillebois, Bourg Les Valence, both of France

[73] Assignee: Crouzet, Montrouge, France

[21] Appl. No.: 368,814

[22] Filed: Jun. 20, 1989

[30] Foreign Application Priority Data

Jun. 27, 1988 [FR] France ..... 88 08718

[51] Int. Cl.[5] ..... G04F 8/00; G04C 19/00

[52] U.S. Cl. ..... 368/82; 368/108

[58] Field of Search ..... 368/82–84, 368/107–113, 223, 228; 377/20

[56] References Cited

U.S. PATENT DOCUMENTS

| | | | |
|---|---|---|---|
| 3,284,715 | 11/1966 | Kaminsky | 328/41 |
| 3,750,384 | 8/1973 | Miller et al. | 368/82 |
| 3,943,288 | 3/1976 | Reed et al. | 368/13 |
| 4,564,845 | 1/1986 | Lamble | 368/107 |

FOREIGN PATENT DOCUMENTS

| | | |
|---|---|---|
| 0009870 | 8/1979 | European Pat. Off. . |
| 2312813 | 5/1976 | France . |
| 2438863 | 10/1979 | France . |
| 1505960 | 9/1976 | United Kingdom . |

*Primary Examiner*—Vit W. Miska

*Attorney, Agent, or Firm*—Stevens, Davis, Miller & Mosher

[57] ABSTRACT

A digital timer with constant resolution comprising a clock and a chain of binary down-counters, each of which corresponds to a timing range which is a mutiple of that of the preceding down-counter. The binary outputs of the down-counters are fed in parallel to display points of a first set of display points, enabling means being provided so that only the output of the most significant down-counter not at zero actuates the display points. A display point of a second set of display points is associated with each down-counter so that only the display point corresponding to the most significant down-counter not at zero is actuated.

5 Claims, 3 Drawing Sheets

DIGITAL TIMER WITH CONSTANT RESOLUTION

BACKGROUND OF THE INVENTION

The present invention relates to the field of digital timers whose most widespread application is in the control of relays.

An object of the present invention is to provide such a timer having an extended timing range.

Another object of the present invention is to provide such a timer whose components can be essentially provided in the form of an integrated circuit.

Another object of the present invention is to provide a timer having a particularly simple display of the time remaining.

SUMMARY OF THE INVENTION

For this, the present invention provides a digital timer with constant resolution comprising a clock and a chain of binary down-counters each of which corresponds to a time range which is a multiple of that of the preceding down-counter. The binary outputs of the down-counters are fed in parallel to display points of a first set of display points, enabling means being provided so that only the output of the most significant down-counter not at zero actuates the display points, and a display point of a second set of display points is associated with each down-counter so that only the display point corresponding to the most significant down-counter not at zero is actuated.

In one embodiment of the present invention, the binary down-counters are respectively a four bit down-counter, down-counting by 16, receiving 16 Hz clock pulses and three 6 bit down-counters, down-counting by 60, receiving the output of the preceding down-counter, so as to deliver sixteenth of a second, second, minute and hour counts, the first set of display points comprising 6 display points and the second set of display points comprising four display points.

In one embodiment of the present invention, a display point is further provided controlled so as to be active when all the down-counters are at zero.

In one embodiment of the present invention, each down-counter is associated with a memory which stores the reference value of this down-counter; each down-counter, except that having the highest rank to which a non zero reference value is assigned, which is loaded to its reference value, is initially loaded to its maximum value; each down-counter comprises an end of down-count indication output which is used for enabling the downcounter of the immediately lower rank to be loaded with the associated reference value, for enabling the connection of the binary of this lower rank down-counter to the first set of display points, and causing activation of the display point of the second set associated with the lower rank down-counter.

BRIEF DESCRIPTION OF THE DRAWINGS

These objects, characteristics, and advantages as well as others of the present invention will be clear from the following detailed description of particular embodiments with reference to the accompanying drawings in which.

DESCRIPTION OF THE PREFERRED EMBODIMENTS

Figure 1:
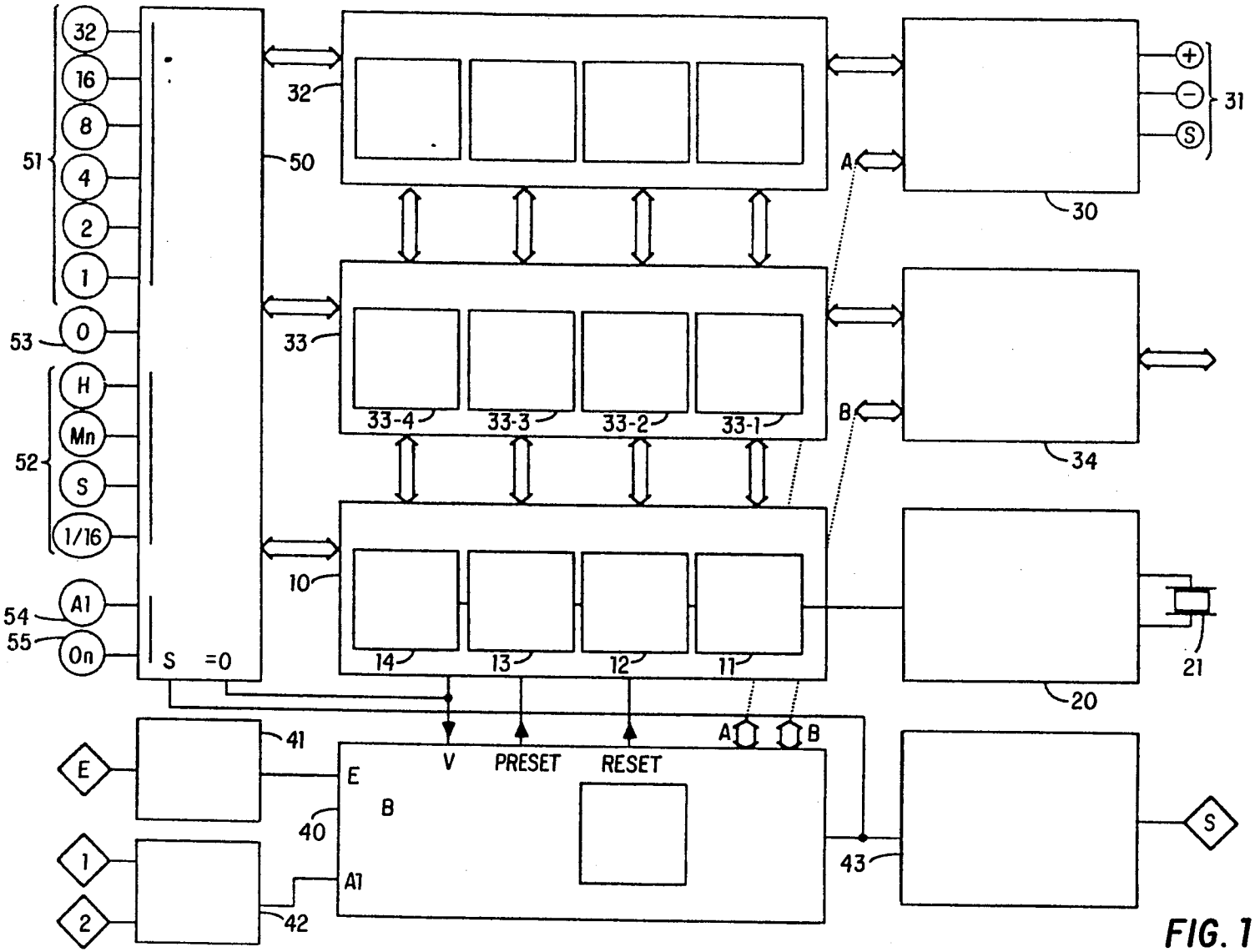
FIG. 1 shows very schematically the general conception of a timer in accordance with the present invention.

This timer is based on a down-counting block 10 comprising for example four down-counters 11, 12, 13 and 14. This block 10 is associated with a time base 20 coupled to a quartz 21. There exist low cost quartzes having a piezoelectric resonance frequency at 32 768 Hz. If the time base divides this frequency by 2048, 16 Hz signals are obtained at the output, i.e. the first down-counting module 11 receives pulses at a frequency of 1/16th of a second. From there, the down-counter 11 may be a divider by 16 and the other down-counters 12, 13 and 14 dividers dividing by 60. Thus, at the output of downcounter 12, a pulse will be obtained every second, at the output of down-counter 13 a pulse every minute and at the output of down-counter 13 a pulse every hour. In order words, the down-counter 11 will count 1/16 ths of a second, down-counter 12 seconds, down-counter 13 minutes and down-counter 14 hours.

To set the duration of the timer, a setting block 30 is provided in a conventional way which is actuated for example by a set of push buttons 31 for setting, in a preselection block 32, timing durations chosen in hours, minutes, seconds and 1/16 ths of a second. The information collected in this preselection block 32 will be delivered to a permanent memory block 33, formed for example by EEPROM, NOVRAM, RAM memories safeguarded by battery or supercapacitor, etc.. Also, a connecting block 34 may be conventionally provided for directly coupling the memory block to a bus connected to an external processor.

These blocks 30 to 34 will not be described in detail for they are relatively conventional and similar devices can be found in other apparatus, for example digital clocks. It is sufficient to mention here that the information corresponding to the chosen timing delay is stored in remanent memories contained in block 33. This block 33 may, as is shown, be divided into word memories 33-1 33-2 33-3 and 33-4, respectively of four bits for block 33-1 and six bits for blocks 33-2 to 33-4.

The total down-count output Z of the down-counting bloxk 10 is delivered to a function block 40 receiving an input from an input circuit 41, a power supply (also intended for the other blocks of the system during operation or initial adjustment) 42 and an output circuit 43 delivering a control signal intended for example to actuate an electromechanical or static relay. The function block makes it possible to send PRESET signals or RESET signals to the down-counting block depending on the program stored beforehand, as is well known in the field of timers, for example so that the timer is only tripped after a given time or only after the arrival of a particular input, whether the output begins by a high level or by a low level, etc..These blocks 40 to 43, also relatively conventional, will not be described here in detail for they already exist in other timers. Finally, the different blocks and particuarly the down-counting block 10 are connected to a display block 50 in which the display points are formed by LEDs. The display block makes it possible to actuate, in a way will be explained in greater detail hereafter, a first set of LEDs 51 which lights up as a function of the state of the binary outputs of a particular down-counter of the down-counting block. Here six diodes have been shown designated by "1", "2", "4", "8", "16", "32", for the case where the down-counters comprise six binary outputs. A second set of LEDs 52 is provided so that one of its diodes is lit to indicate the down-counter whose value is displayed by block 51. In the case of the preceding example, these diodes are marked "H", "M", "S" and "1/16th" so as to show that they refer respectively to each of the hour, minute, second and 1/16th second down-counters. A diode 53 is provided for lighting up when all the down-counters are at zero (and possibly for winking during the setting phase). A diode 54 reflects the switching on of the power supply and a diode 55 reflects the fact that the output is at a high or low level.

Thus, the same diodes of the set of diodes 51 are used for indicating the time remaining during operation of the timer.

For example, if a timing setting of 35 hours, 30 minutes, 16 seconds, and 5/16ths of a second is chosen, the first display will represent the value 35 (diodes "32", "2" and "1" lit) whereas diode "H" of group 52 will be lit. This time in hours is decremented while downcounter 14 down-counts. When down-counter 14 reaches zero, the diode "H" of group 52 will go out whereas the diode "M" of this same group will light up and the value 30 will be displayed (diodes 16, 8, 4 and 2) then this count will be decremented until the end of down-counting of the minutes down-counter. Then, the diode "S" will light up at the same time as the diode "16" of group 51 to show that 16 seconds remain. Finally, the diode 1/16 of group 52 will light up and the display of its down-count will appear extremely rapidly.

Figure 2:
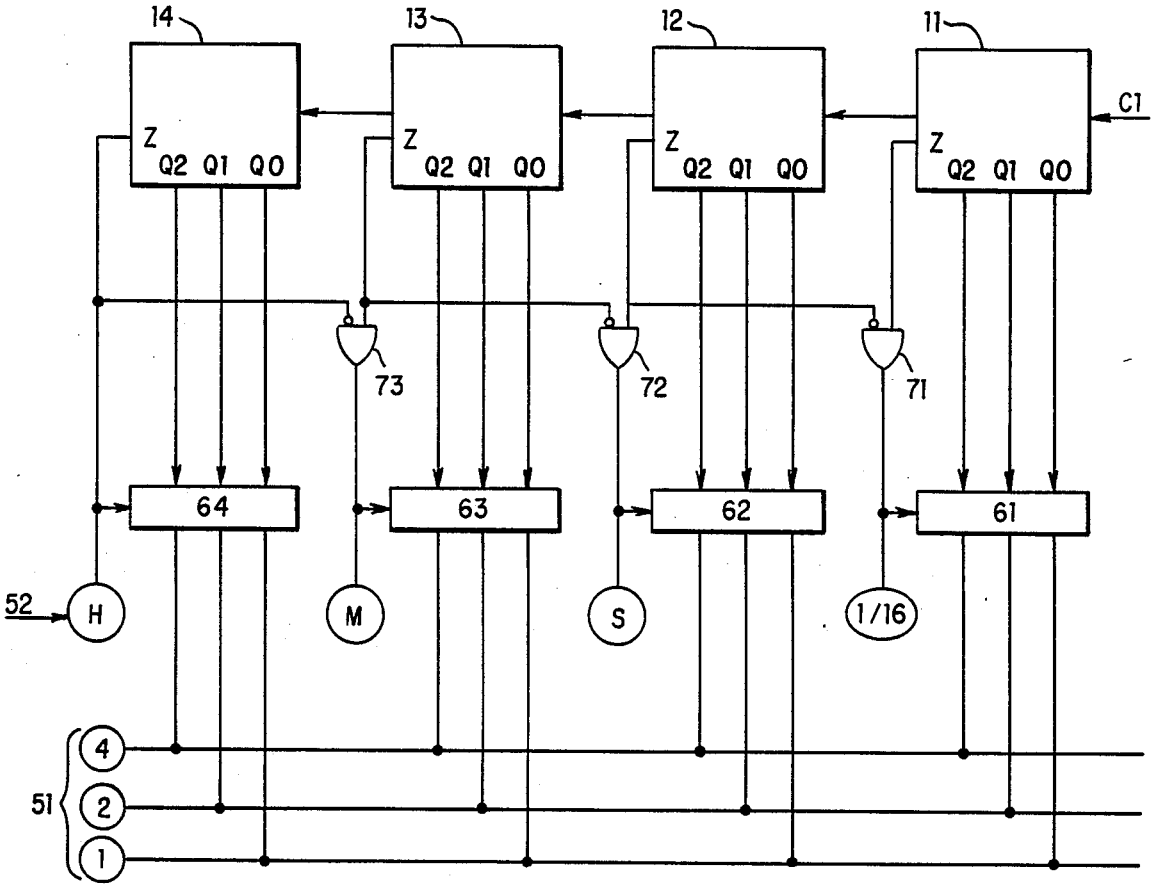
FIG. 2 shows in block form in a simplified way the display circuits used in a timer according to the present invention.

FIG. 2 represents very schematically and in the form of blocks the coupling between down-counters 11 to 14 and the diodes of the groups of diodes 51, 52. To simplify the figure, each down-counter has been shown with only three binary outputs and so only three diodes in the group of diodes 51, these diodes being marked "1", "2", and "4". The binary outputs Q2, Q1 and Q0 of each of the down-counters 11 to 14 are connected through respective enabling circuits 61 and 64 to diodes "1", "2", "4" and logic circuits are provided for enabling each of the circuits 61 to 64 and activating the corresponding diode of group 52 only when the corresponding down-counter is the most significant down-counter whose output it not zero. This is symbolized by the connection between the zero cross over indication outputs (Z) of each of the down-counters and blocks 61 to 64.

In the case of this figure, it is assumed that the output (Z) of a down-counter is at 1 when it is not at zero and passes to zero when this down-counter is empty. The output Z of the most significant down-counter 14 is connected directly to the enabling input of circuit 64 and to diode H. The enabling inputs of circuits 61 to 63 are connected to the input Z of the corresponding downcounters 11 to 13 through AND gets 71 to 73 whose other input receives the inverse of the output signal Z of the higher rank down-counter.

Figure 3:
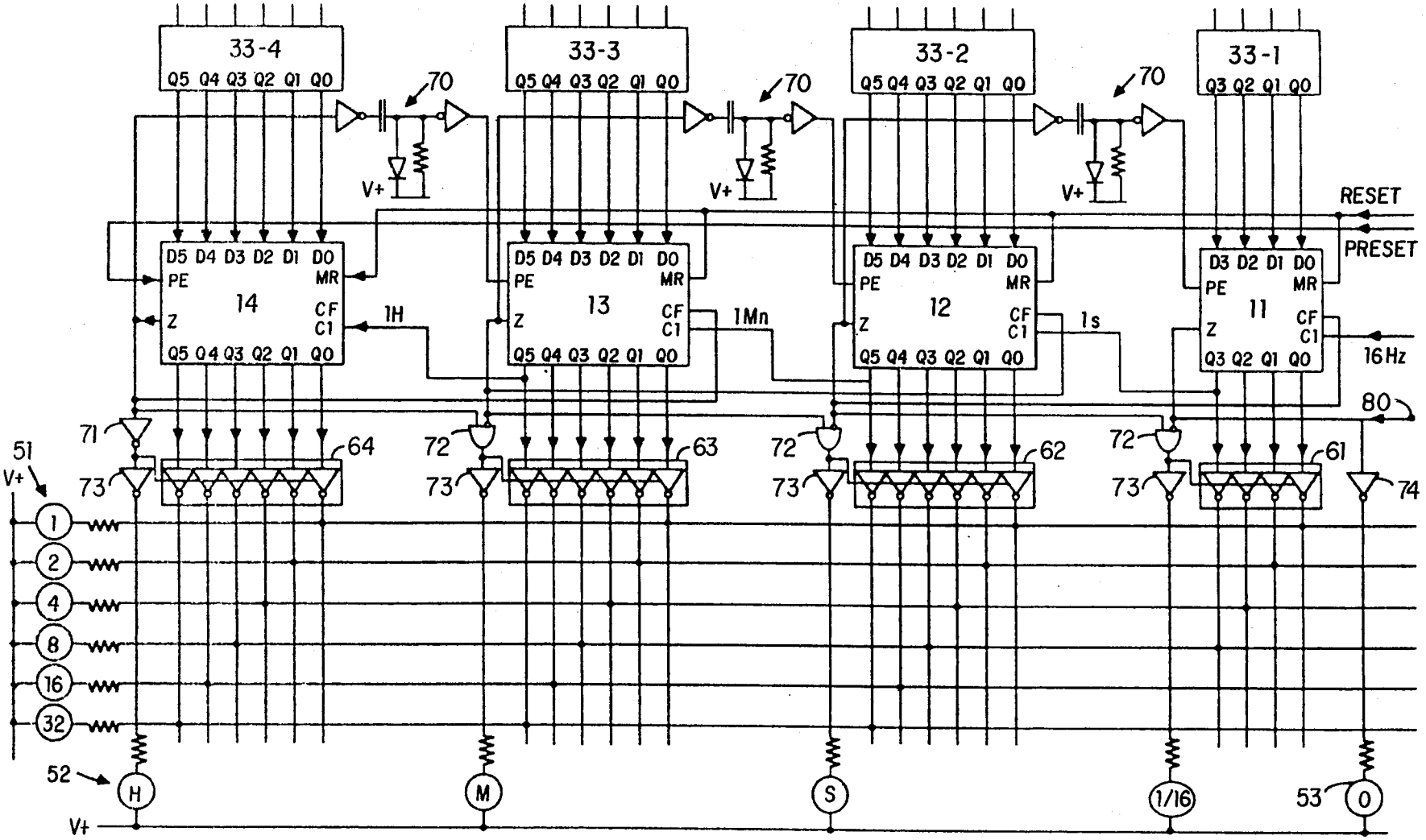
FIG. 3 shows in greater detail one embodiment of the display and time down-counting device of a timer according to the present invention.

FIG. 3 shows in more detail one embodiment of the present invention and more precisely the connections between the down-counting block 10 and the memory 33 and display 50 blocks of FIG. 1. We are in the case of the numerical examples of FIG. 1.

Each of the down-counters 11, 12, 13, 14 comprises:

six programming inputs D0 to D5 (four for down-counter 11), six binary down-counting outputs Q0 to Q5 (four for down-counter 11), an output Z which is at the low level (0) when a down-counter is programmed or is being down-counted and which passes to the high level (1) when the down-counter has finished down-counting, if the input CF is itself at the high level, a rest input MR, an input PE for programming the down-counter to the value fixed by inputs D0 to D5, an input CF for programming the down-counter to its 35 maximum value and a clock input CL.

The input CL of each of the down-counters is connected to the highest rank binary output of the preceding downcounter except in so far as down-counter 11 is concerned which receives the 16 Hz clock signal.

The input PE of the highest rank down-counter, downcounter 14, receives the signal PRESET from the function block (see FIG. 1). The input PE of the other downcounters are connected to the output Z of the immediately higher rank down-counter through a pulse shaping circuit 70 formed of two inverters connected together by a derivator.

All the inputs MR of the down-counters are connected to the RESET input from the function block (see FIG. 1) for resetting.

The input CF of the highest rank down-counter is not connected and the inputs CF of the other down-counters are connected to the output Z of the immediately higher rank down-counter.

As was explained in the case of the simplified example of FIG. 2, the outputs Q0 to Q5 of down-counters 12, 13 and 14 and the outputs Q0 to Q3 of down-counter 11 are connected to the first set of LEDs 51, respectively "1", "2", "32", through enabling circuits 61 to 64. These enabling circuits are formed of inverters controlled as shown in FIG. 3. The control input of each of the enabling blocks is connected to the output Z through an inverter 71 for the highest rank down-counter and an AND gate 72 for the other down-counters. Each gate 72 receives at a first inverting input the output Z from the corresponding down-counter and at a second non inverting input the output Z from the down-counter of immediately higher rank. Furthermore, the output of inverter 71 and those of each of the AND gates 72 are connected through inverters 73 to the respective LEDs "H", "M", "S", "1/16", of the second group of diodes 52. Moreover, the end of down-counting display diode of the whole of the down-counting block, designated by the reference 53 in FIGS. 1 and 3, is connected to the output Z of the lower rank down-counter 11 through an inverter 74. This output Z of down-counter 11 corresponds also to the output 10 of the down-counting block.

The operation of this device will be described below.

It is assumed that the memories 33-4 to 33-1 contain the values in hours, minutes, seconds and 1/16ths of a second, chosen for the timer. When the signal appears for staring up the down-counters (signal PRESET), downcounter 14 is loaded with the value of memory 33-4, downcounters 11, 12 and 13 having a 0 level at their inputs CF, each of which is connected to the output Z of the preceding down-counter so that these down-counters are loaded the their maximum value (60 for down-counters 12 and 13, and 16 for down-counter 11). Down-counting of downcounter 14 occurs then at the timing imposed by the preceding chain of down-counters, i.e. this down-counter decrements its binary outputs by a unit every hour. The LED "H" of group 52 lights up and the LEDs of group 51 reflect the time remaining in hours.

Once down-counter 14 has finished its down-counting, its output Z passes to 1 and inhibits the input CF of the following down-counter and enables the input PE of this down-counter so that it is loaded to the value programmed in the corresponding memory. The corresponding LED of group 52 lights up and the diodes of group 51 indicate the time remaining. The procedure is then repeated for the following down-counters until a signal is delivered to the output 80 when down-counter 11 has finished its count.

It will be noted from the preceding description that the present invention may be used simply in the form of an integrated circuit for it only includes conventional and readily integratable components (gates and inverters). Furthermore, one advantage of the general organization of the structure of the present invention is that it requires a minimum of memory points for keeping programming information of a timer in a remanent way.

What is claimed is:

1. A digital timer with constant resolution, comprising a clock and a chain of binary down-counters each of which corresponds to a time range which is a multiple of that of the preceding down-counter, wherein the binary outputs of said binary down-counters are fed in parallel to display points of a first set of display points, enabling means being provided so that only the output of the most significant down-counter not at zero actuates the display points, and a display point of a second set of display points is associated with each down-counter so that only the display point corresponding to the most significant down-counter not at zero is actuated.

2. The timer as claimed in claim 1, wherein said binary down-counters are respectively a four bit down-counter down-counting by 16, receiving 16 Hz clock pulses and three 6 bit down-counters down-counting by 60, receiving the output of the preceding down-counter, for delivering 1/16 second, second, minute and hour counts, the first set of display points comprising six display points and the second set of display points comprising four display points.

3. The timer as claimed in claim 2, further comprising a display point controlled so as to be active when all the down-counters are at zero.

4. The timer as claimed in claim 1, wherein:

each down-counter is associated with a memory which stores the reference value of this down-counter, each down-counter except that of the higher rank to which a non zero reference value is assigned which is loaded to its reference value, is initially loaded to its maximum value, each down-counter comprises an end of down-count indication output which is used for enabling loading in the down-counter of immediately lower rank the associated reference value, for enabling the connection of the binary outputs of this lower rank down-counter to the first set of display points and causing activation of the display point of the second set associated with the lower rank down-counter.

5. The timer as claimed in claim 1, wherein each display point is formed by a light emitting diode.

* * * * *